United States Patent [19]

Cole et al.

[11] 4,052,169

[45] Oct. 4, 1977

[54] TREATMENT OF SOLID FUELS

[75] Inventors: Edward L. Cole, Fishkill; Howard V. Hess, Glenham; William F. Franz, Gardiner, all of N.Y.

[73] Assignee: Texaco Inc., New York, N.Y.

[21] Appl. No.: 551,484

[22] Filed: Feb. 20, 1975

[51] Int. Cl.[2] ..... B02C 1/00; C10L 9/10; C10B 57/00

[52] U.S. Cl. ..... 44/1 R; 201/17; 241/17

[58] Field of Search ..... 44/1 R, 1 G; 201/17; 241/17

[56] References Cited

U.S. PATENT DOCUMENTS

| | | | |
|---|---|---|---|
| 2,560,807 | 7/1951 | Lobo | 241/17 X |
| 2,830,769 | 5/1958 | Work | 241/17 X |
| 2,885,154 | 5/1959 | Eastman et al. | 241/17 X |
| 3,660,054 | 5/1972 | Rieve | 44/1 R |

*Primary Examiner*—Carl F. Dees

*Attorney, Agent, or Firm*—Thomas H. Whaley; Carl G. Ries; Robert Knox, Jr.

[57] ABSTRACT

The heating value of solid fuel is increased and the particle size decreased by passing a slurry of the fuel in liquid water at a temperature between 400° F. and the critical temperature of water through a tubular attrition under conditions of turbulent flow. The product slurry is suitable for pipelining.

9 Claims, No Drawings

TREATMENT OF SOLID FUELS

This invention relates to the upgrading of solid fuels. More particularly it is concerned with the beneficiation and transportation of low rank solid fuels such as sub-bituminous coal and lignite.

Millions of tons of low rank solid fuels exist in this country and although many of these deposits are close to the earth's surface and may be readily mined they are not used extensively as fuels because for the most part they are located at a considerable distance from the point of ultimate use and in addition they have several undesirable characteristics which make them less valuable as fuels. For example, although these low rank fuels generally have a relatively low sulfur content they still contain too much sulfur to permit their use as a fuel and yet meet current regualtions with respect to $SO_2$ emissions. In addition, to make these coals economically attractive means must be found for separating the components of the coal having little or no heating value from those components have a higher heating value. Thus, inorganic mineral matter, water and carbon-dioxide are desirably removed from such fuels to produce a fuel having a higher BTU per pound value and thereby produce a fuel which is more economic to transport either by rail or pipeline. Additionally, since much of the fuel is handled by mechanical equipment advantageously it is converted to finely-ground form.

The bulk of the water in low rank solid fuels such as lignite and sub-bituminous coal may be removed by drying the fuel with a hot flue gas or a hot oil. However, the removal of ash-forming minerals from low rank coals is difficult and ordinary benefication techniques such as jigging, tabling or sink-and-float techniques are not particularly efficient with the low rank fuels. Ash-forming minerals generally occur in mined coals either as "segregated impurities" or as an inherent part of the coal. The segregated ash-forming impurities are those that exist as individual discrete particles when the coal has been broken down. They are composed for the most part of shale, clay, sand, stone and other mineral material derived either from strata interbedded with the coal or from the roof and floor of the coal bed. Ordinarily they are removable by mechanical means. On the other hand the term "inherent" or "fixed" ash is used to distinguish that part of the impurity in the coal which cannot be separated by mechanical means. For economic and practical reasons, therefore, it is desirable to reduce the ash content of the fuel but conventional procedures have little effect on the fixed ash.

Size reduction of coals is achieved by the use of crushers or grinders. The equipment selected will depend on the feed size, the hardness of the coal, the size of the coal as desired in final form and the economic factors involved in a particular installation. The hardness or the grindability of the coal determines the amount of work required to achieve a good size reduction.

The preparation of solid fuels for slurry pipelining is a costly operation involving several grinding steps. Generally, the run of the mine coal passes through three devices for size reduction with vibrating screens between the steps before the desired size is achieved. The first stage of a size reduction uses a crusher for coarse reduction of the fuel. The maintypes used are jaw crushers, gyratory crushers, smooth roll crushers and tooth-roll crushers The last is particularly suitable for lignite and sub-bituminous coal. In these devices, the fuel is reduced to a size below 2 inches. For intermediate duty, hammer mills and impactors are generally used to reduce the particle size to less than ⅜ inch. Final size reduction to less than ⅛ inch may be obtained with roller mills, attrition mills or revolting mills such as rod or ball mills. The powdered coal, having the proper size, is slurried with water in a tank equipped with agitation and is maintained under constant agitation while it is fed from a line at the bottom of the tank to the suction line of the charge pump for the pipeline. If desired, the final size reduction may be carried out with the fuel in a water slurry.

We have now discovered an improved method for upgrading solid fuels and simultaneously converting the fuel to finely ground form. According to our invention a solid fuel is beneficiated and converted to finely ground form by a process which comprises forming a mixture of particulate solid fuel and water, passing the mixture under conditions of turbulent flow through a heating zone to raise its temperature to between about 400° and 700° F. at a pressure sufficient to maintain substantially all of the water in liquid state, passing the heated mixture under conditions of turbulent flow through an elongated attrition zone for a period of time between about 5 seconds and 1 hour and then cooling the mixture. A preferred time at temperature is between 10 seconds and 10 minutes.

Any solid fuel may be treated by the process of our invention but it is particularly suitable for the treatment of low rank solid fuels such as lignites and sub-bituminous coals classified as III and IV at page 57 of the Annual Book of ASTM Standards, Part 19, 1973 edition. The fuel is subjected to a preliminary mechanical grinding by means of a crusher to convert the fuel to particles having a maximum cross-sectional dimension of less than two inches preferably to convert the fuel to particles of which a majority has a maximum cross-sectional dimension between ⅜ inch and 1 inch.

The crushed fuel is then formed into a mixture with water, the water being present in an amount between about 40 and 75% by weight, preferably between 40 and 60% by weight as, if the water content is less than about 40%, the mixture becomes difficult to pump. The mixture is then pumped through a heating zone under conditions of turbulent flow and heated to a temperature between about 400° F. and the critical temperature of water, preferably between about 500° and 650° F. The pressure in the heating zone should be sufficiently high to keep substantially all of the water in liquid state.

The heated mixture is then passed into an elongated tubular attrition zone through which it is passed under turbulent flow conditions at substantially the same temperature and pressure as it left the heating zone, taking sufficient pressure drop to achieve the desired level of turbulence. The Reynolds Number in the attrition zone should be between 1000 and 100,000 preferably between 5,000 and 50,000.

During the heating-attriting process, gases are released which serve to increase the turbulence. However, they should be vented prior to introducing the slurry into the pipeline. Advantageously, the properties of the slurry are measured before it is fed into the pipeline. This may be done by inline sensing devices or by withdrawing portions of the slurry for analysis. In the event that size reduction is insufficient, a recycle line may be provided and a slip stream returned to the heating-attriting zone for additional size reduction. When the recycle stream is added to the normal feed stream, it has the effect of increasing the velocity of the flow through the heating-attriting zone with the net effect that turbulence and thus the attriting or grinding action is increased. Turbulence in the attriting zone may also be enhanced by providing sharp bends or by incorporating sections of reduced diameter in the tube. After it has passed through the attriting zone, not only is the slurry suitable for pipelining but in addition, there is a considerable increase, on a dry basis, of the heating value of the fuel after the treatment.

The following example is submitted for illustrative purposes only and it should not be construed that the invention is limited thereto.

EXAMPLE

In this example, the charge is a sub-bituminous coal having the following analyses.

TABLE 1

| | |
|---|---|
| Proximate Analysis | |
| Moisture, % | 19.5 |
| Ash, % | 28.4 |
| Volatile Matter, % | 28.3 |
| Fixed Carbon, % | 23.8 |
| Ultimate Analysis | |
| Moisture, % | 19.5 |
| Carbon, % | 39.4 |
| Hydrogen, % | 3.4 |
| Nitrogen, % | 0.6 |
| Sulfur, % | 1.4 |
| Ash, % | 28.4 |
| Oxygen, % | 7.3 |
| Heat of Combustion, BTU/lb. | |
| Gross | 5,936 |
| Net | 5,628 |

The run of mine coal is fed to a tooth-roll crusher wherein the size of the coal is reduced to a product having no material above one-inch. The coal is transferred via an independently sectioned belt scale to a mixing tank where water is added to make a slurry which is maintained at 53–55 weight per cent solids content. A high pressure pump discharges 1100 tons per hour of the slurry at a pressure of 1700 psig, to a fired heater rated at 600 MM BTU/hr. The slurry leaves the heater at a temperature of 600° F. and a pressure of 1600 psig. The hot slurry is fed to the attrition line having a diameter of 5 inches an a length of 800 feet. The flow is turbulent as shown by a Reynolds No. of 10,000. The size distribution of the coal and its heating value before and after treatment are tabulated below.

TABLE 2

| U. S. Standard Sieve | Charge | Product |
|---|---|---|
| plus 20, wt. % | 81.4 | 8.8 |
| −20 + 325, wt. % | 14.7 | 81.0 |
| minus 325, wt. % | 3.8 | 10.1 |
| Heat of Combustion BTU/lb. (dry basis) | 7360 | 8520 |

The product slurry is fed into a Schedule 40 steel pipe having an O.D. of 18 inches. At a flow rate of 4 mph the slurry flows smoothly and is characterized as being stable in that it retains its fluidity under static conditions rather than reverting to a highly immobile mass.

Various modifications of the invention as hereinbefore set forth may be made without departing from the spirit and scope thereof, and therefore, only such limitations should be made as are indicated in the appended claims.

We claim:

1. A process for beneficiating and grinding solid fuel which comprises forming a mixture of particulate solid fuel having a majority of particles larger than U.S. Standard screen opening No. 20 and water, passing the mixture under conditions of turbulent flow through a heating zone to raise its temperature to between about 400 and 700° F. at a pressure sufficient to maintain substantially all of the water in liquid state, passing the heated mixture at substantially the same temperature and pressure as it left the heating zone under conditions of turbulent flow through an elongated attrition zone for a period of time between about 5 seconds and 1 hour to form a mixture having a majority of particles smaller than U.S. Standard screen opening No. 20 and then cooling the mixture.

2. The process of claim 1 in which the temperature is between 500° and 650° F.

3. The process of claim 1 in which the time is between 10 seconds and 10 minutes.

4. The process of claim 1 in which the Reynolds Number of the slurry in the attrition zone is between 1,000 and 100,000.

5. The process of claim 4 in which the Reynolds Number is between 5,000 and 50,000.

6. The process of claim 1 in which the solid fuel is sub-bituminous coal.

7. The process of claim 1 in which the solid fuel is lignite.

8. The process of claim 1 in which the treated mixture is a stable slurry.

9. The process of claim 1 in which the mixture charged to the heating zone contains between 40 and 75% water.

* * * * *